United States Patent [19]

Douglas

[11] Patent Number: 4,640,163

[45] Date of Patent: Feb. 3, 1987

[54] UMBILICAL SAFETY JOINT

[75] Inventor: Larry D. Douglas, Cypress, Tex.

[73] Assignee: Multiflex International, Inc., Magnolia, Tex.

[21] Appl. No.: 769,130

[22] Filed: Aug. 26, 1985

[51] Int. Cl.[4] ..... B26D 7/14

[52] U.S. Cl. ..... 83/175; 83/200; 114/221 A

[58] Field of Search ..... 83/175, 200, 199, 198, 83/196; 114/221 A; 166/54.5, 54.6

[56] References Cited

U.S. PATENT DOCUMENTS

| | | | |
|---|---|---|---|
| 2,072,341 | 3/1937 | McCullough . | |
| 2,495,732 | 1/1950 | Jessen | 83/199 X |
| 2,649,913 | 8/1953 | Linder | 83/200 |
| 2,777,696 | 1/1957 | Magill | 83/199 X |
| 2,825,536 | 3/1958 | Kenneday et al. . | |
| 3,517,740 | 6/1970 | Johnson . | |
| 3,882,748 | 5/1975 | Moore | 114/221 A X |
| 3,926,252 | 12/1975 | Ribeyre et al. | 114/221 A X |
| 4,237,972 | 12/1980 | Lanmon, II . | |
| 4,306,622 | 12/1981 | Armstrong . | |
| 4,548,111 | 10/1985 | Tarbuck | 83/200 X |

*Primary Examiner*—Frank T. Yost

*Attorney, Agent, or Firm*—Pravel, Gambrell, Hewitt & Kimball

[57] ABSTRACT

A safety joint for a multitube hose bundle which separates and severs the control hoses when a predetermined tension is exceeded. The control hoses are severed by a rotating cutting blade activated by a pin in cam slot which rotates the cutting blade upon separation of the safety joint.

14 Claims, 4 Drawing Figures

UMBILICAL SAFETY JOINT

FIELD OF THE INVENTION

The present invention relates to a umbilical safety joint to sever the control cables in a subsea flexible hose bundle when a predetermined tension is exceeded.

BACKGROUND OF THE INVENTION

A subsea control umbilical may be employed to connect remotely positioned subsea satellite production and/or injection christmas trees to subsea template controls or to surface controls on a platform loading production vessel. Subsea control umbilicals are also employed to connect several small subsea templates together before ascending to the surface platform or vessel. A riser bundle or umbilical can include up to eighteen separate control hoses within a casing. The casing may include an armor outer surface to protect the enclosed control hoses.

The distances between subsea components may range from a few hundred feet to as much as ten to twenty miles. The subsea control umbilical connecting subsea christmas trees and templates together are subject to damage by vessel mooring lines and anchors, fishing vessels using trawling boards, subsea mudslides and ocean floor drift. The most common damage to such subsea control umbilicals is caused by mooring lines or anchors snagging the subsea control umbilical and tearing it away from the christmas tree, template termination or riser base. The loads on such subsea components are extreme when the subsea control umbilical is snagged by anchors and pulled away. The breaking strength of the umbilical armor may range from 30,000 pounds to 80,000 pounds depending upon wire gauge and material strength.

The riser bundle or umbilical preferably includes a safety joint which will separate when a predetermined tension on the umbilical is exceeded.

Typically such safety joints employ "weak link" bolts as connection means which are designed to break when a predetermined tension is exceeded to allow separation of the armor casing. Upon separation of the weak link bolts, the inner control hoses are typically allowed to break under the tension. Often, the control hose connections can be damaged during such tension failure. Further, the separation of the control hoses due to such stretching tension failure is not a predictable occurrence and control hose segments other than in the area of eventual failure can be weakened by stretching.

SUMMARY OF THE INVENTION

The present invention relates to a new and improved umbilical safety joint which provides for a separation of armor casing upon overtensioning of a riser bundle or subsea unbilical and further provides for a cutting of the enclosed control hoses upon separation of the safety joint. The present invention avoids the possibility of damage to the control hose connections and the subsea equipment and possible stretch weakening of the control hoses by cutting the control hoses upon failure of weak link connecting bolts. The cutter of the present invention comprises a cutting disc which rotates upon separation of concentric casing sections through the action of a pin in a cam slot. A cutting disc is oriented perpendicular to the longitudinal axis of the control hoses and between an alignment plate and a wear plate. The alignment plate, wear plate and cutter blade include holes through which the control hoses are oriented. Upon separation of the concentric casing elements, a pin in one element which extends into a cam slot in a cam ring causes rotational action of the cutting blade attached to the cam ring which severs the control hoses at the point where they pass through the alignment plate and wear plate which are attached to the other casing section. The umbilical safety joint of the present invention provides for the cutting of the control hoses in a riser bundle when a predetermined tension is exceeded through the action of an economical reusable rotating disc cutter. The cutting off of control pressure closes control and safety valves. The severing of the control hoses thus effectively shuts down operation of the subsea equipment.

DESCRIPTION OF THE PREFERRED EMBODIMENT

Figure 1:
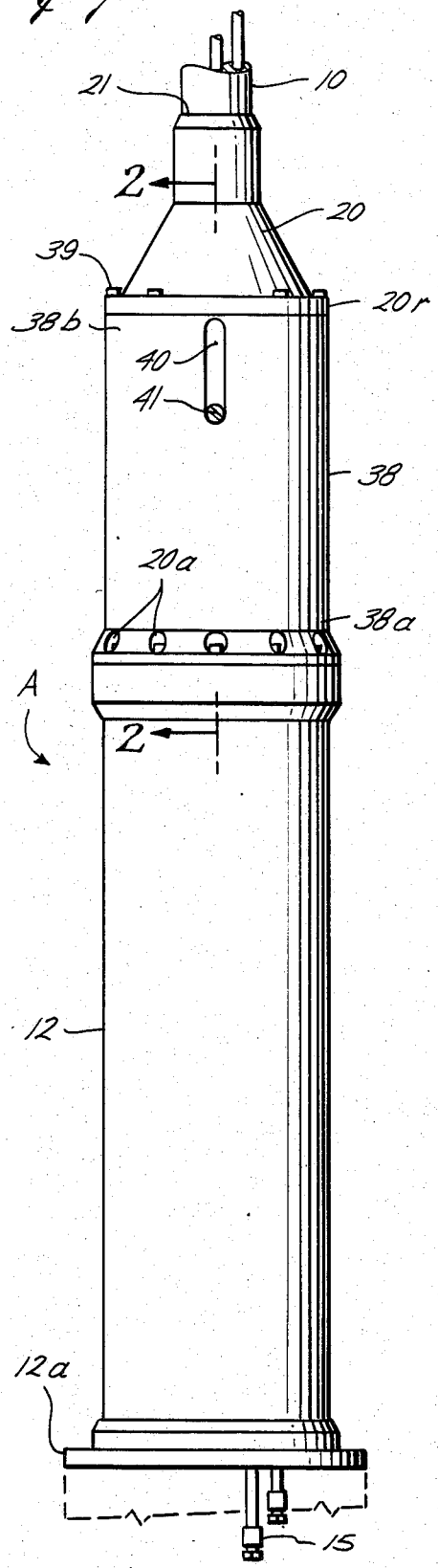
FIG. 1 is a side view of the umbilical safety joint of the present invention.
Figure 2:
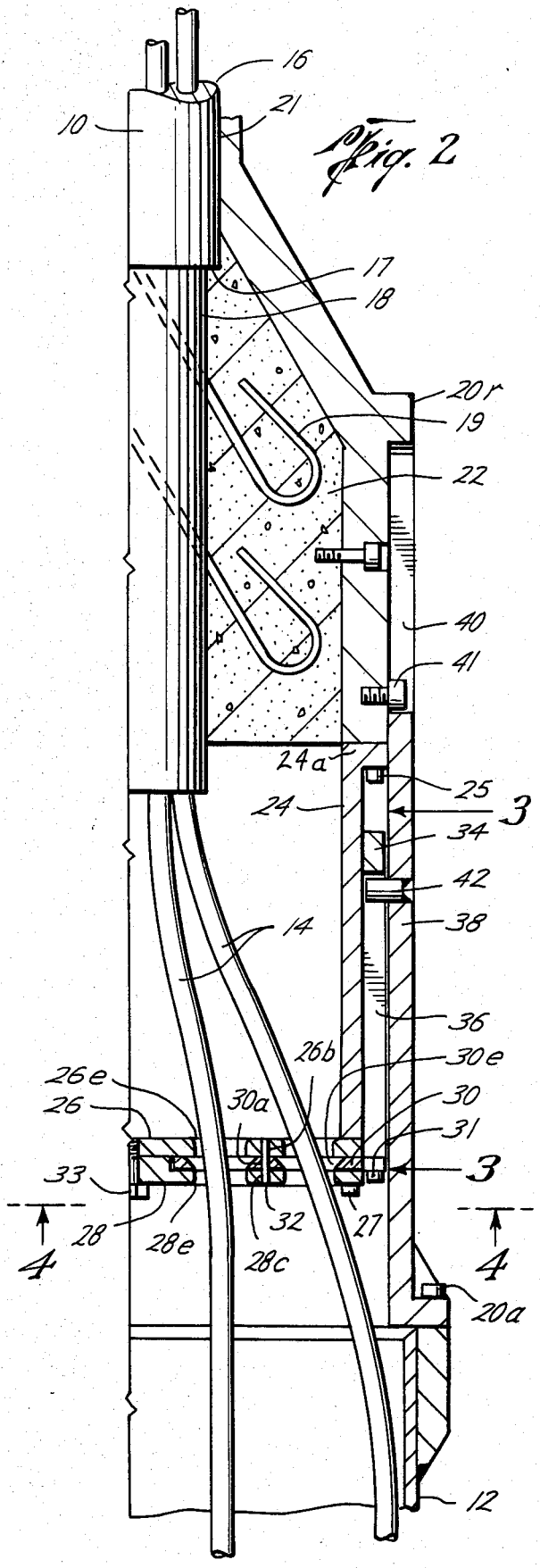
FIG. 2 is a cross-sectional view along line 2—2 of FIG. 1.

The umbilical safety joint A of the present invention is adapted for orientation between a control umbilical bundle 10 and a flexible pipe termination 12 in a subsea control system. The control umbilical 10 can be a riser bundle which extends from a surface vessel or platform to subsea equipment such as a wellhead assembly known as a christmas tree or a subsea umbilical extending between subsea equipment. A control umbilical 10 contains control hoses 14, typically up to eighteen, which supply hydraulic fluid under pressure to the control valves of the subsea equipment. The control umbilical 10 includes armor coating such as wires 18 surrounding the control hoses 14 for protection. The control umbilical 10 is attached to a termination body 20 which is bolted by bolts **20*a* or other suitable means to a flexible tubular termination 12 which is attached at flange plate 12*a* to a well christmas tree or other subsea equipment (not shown) by bolts or other known means. The flexible termination 12 is a flexible tubular enclosure for the control hoses 14 which terminate in connections 15 which are connected in the known manner to various parts of the wellhead assembly in the underwater location. Although only two hoses 14 are shown in FIG. 1, it will be understood that a bundle 10** may have many hoses.

The termination body 20 includes a means of anchoring a riser bundle armor coating to the termination body 20. Preferably, the armor coating includes an outer polymer layer 17 and interior wire reinforcements 18. The riser bundle is oriented through an opening 21 in the termination body 20. The coating 17 is removed and segments of the interior wires 19 are unwrapped to extend outwardly from the bundle. The extending wire segments 19 are surrounded with an epoxy wire locking compound 22 thereby rigidly connecting the riser bundle 10 to the termination body 20. Extending from the termination body 20 is a cylindrical support sleeve 24 attached to the termination body 20 by bolts 25 or other suitable means.

The support sleeve 24 has attached to the end 24*a* opposite the attachment to the termination body a circular alignment plate 26 and a circular wear plate 28. The alignment plate 26 and wear plate 28 include a plurality of holes 26*h* and 28*h*, respectively, each of which is large enough to allow one of the control hoses 14 to be oriented therethrough. Edges 26*e* and 28*e* of holes 26*h* and 28*h* are beveled so as to remove sharp edges which might otherwise damage the control hoses 14. Alignment plate 26 and wear plate 28 are mounted to the support sleeve 24 at their outer edge by bolts 27 or other suitable fastening means.

A substantially circular cutter blade 30 is oriented between alignment plate 26 and wear plate 28. Cutter blade 30 includes a plurality of holes 30*h* corresponding in number and pattern to those in alignment plate 26 and wear plate 28. The edges of the holes 30*h* in the cutter blade 30 are sharp and preferably are formed at an angle so that as cutter blade 30 is rotated with respect to alignment plate 26 and wear plate 28 the control hoses 14 passing therethrough are severed, as will be more fully explained.

Cutter blade 30 has a radius larger than that of alignment plate 26 and wear plate 28 and includes slots 30*s* which correspond to the location of bolts 27 in order to allow limited rotational movement of cutter blade 30 relative to the alignment plate 26 and wear plate 28. Located at the center of cutter blade 30, alignment plate 26 and wear plate 28 is axial bolt 33 around which cutter blade 30 is free to rotate. Extending through cutter blade 30, alignment plate 26 and wear plate 28 is a shearable lock pin 32. Lock pin 32 extends through holes 32*a*, 32*b* and 32*c* in the cutter blade 30, alignment plate 26 and wear plate 28, respectively, when the holes 26*h*, 28*h*, 30*h* are in alignment. Lock pin 32 maintains the holes in alignment until cutter 30 is rotated as described hereinbelow.

Figure 3:
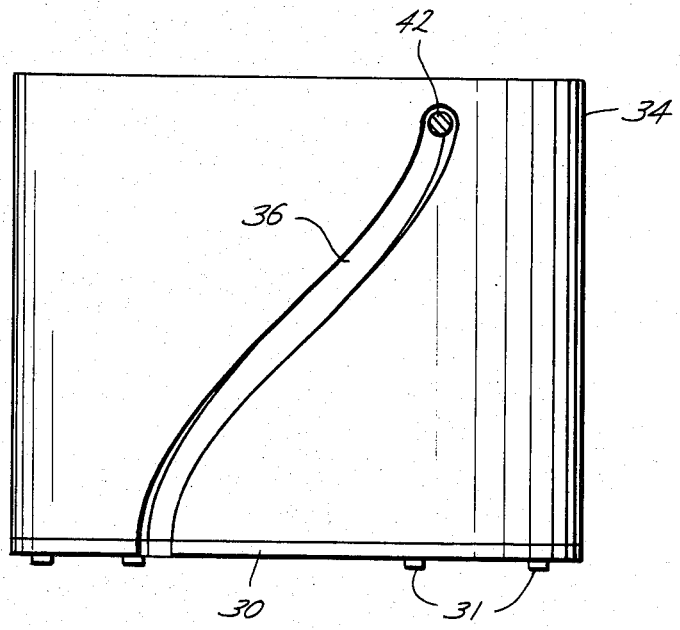
FIG. 3 is a top view of the cam ring of the present invention along line 3—3 of FIG. 1.
Figure 4:
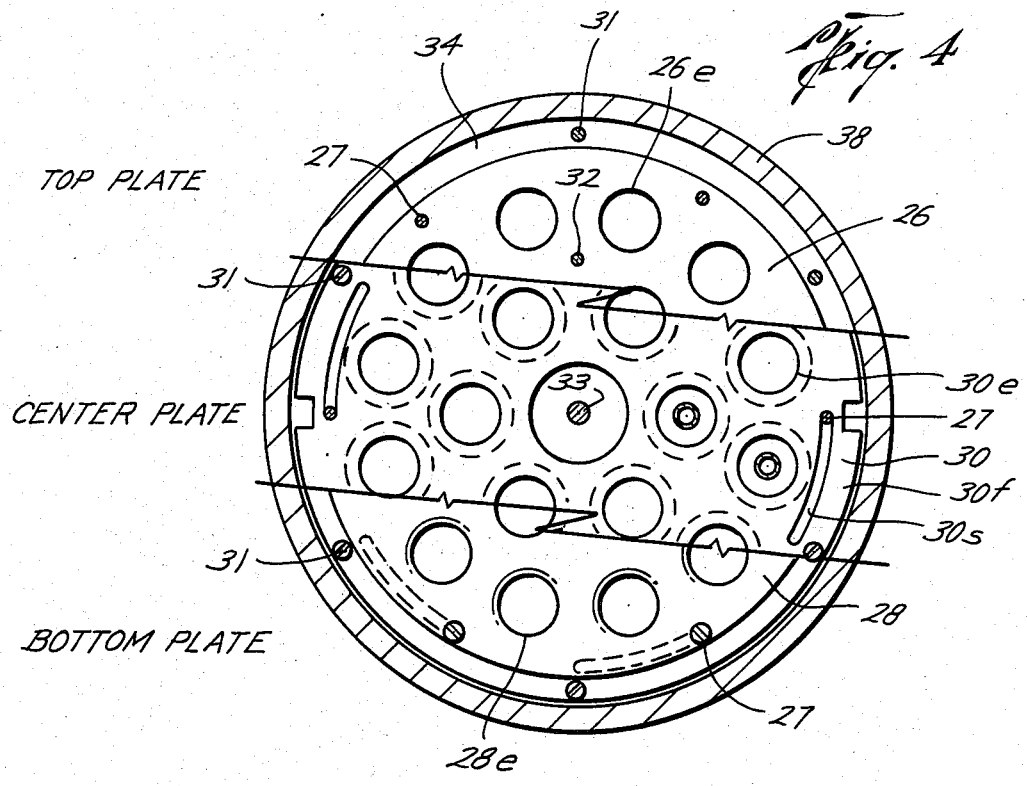
FIG. 4 is a sectional cross-sectional view along line 4—4 of FIG. 1.

Cutter blade 30 is attached at its outer edge 30*f* to a cam ring 34 concentric with support sleeve 24. Cam ring 34 is a cylinder of an inner diameter such that it will fit over support sleeve 24 and freely rotate thereabout. Cam ring 34 has a cam slot 36 (FIG. 3) which is a helical shape.

A cylindrical retainer sleeve 38 is positioned around cam ring 34 and terminator body 20. The retainer sleeve 38 is rigidly connected at one end 38*a* to the flexible pipe termination 12 by bolts 20*a* or other suitable fastening means. The other end 38*b* of retainer sleeve 38 is attached by bolts 39 to a ring shaped ridge 20*r* extending from the termination body 20. The bolts 39 used to connect the retainer sleeve 38 to the termination body 20 are "weak link" bolts. Weak link bolts are of a known design and material such that they will fail at a predetermined tension.

Retainer sleeve 38 includes a longitudinal alignment slot 40 at end 38*b*. An alignment screw 41 is located in the alignment slot 40 extending into the termination body 20 to prevent rotation between the retainer sleeve 38 and termination body 20 as the sleeve 38 is moved longitudinally relative to the body 20 and the parts fixed thereto along the longitudinal axis of the safety joint.

A guide pin 42 extends radially inwardly from the retainer sleeve 38 and into cam slot 36 of cam ring 34. As retainer sleeve 38 is moved longitudinally with respect to the termination body 20, guide pin 40 travels through the helical slot 36 in cam ring 34 causing a rotation of the cam ring 34 with respect to the support sleeve 24, alignment plate 26, and wear plate 28. The resulting relative rotation between the cutter blade 30 attached to the cam ring and alignment plate 26 and wear plate 28 severs the control hoses 14.

In practice, umbilical safety joint A of the present invention would typically be used at the connection of a subsea umbilical 10 to a subsea christmas tree (not shown) or at the connection of a subsea umbilical to subsea equipment. The control hose ends 15 would be connected to the valves of the christmas tree and flexible pipe termination 12 bolted to the christmas tree at flange 12*a* attached to flexible pipe termination 12 by welding or other suitable means. Each of the control hoses 14 would extend through one of the aligned holes 26*h*, 28*h* and 30*h* in the alignment plate 26, wear plate 28 and cutter blade 30, respectively. Lock pin 32 retains the alignment of the holes so as to avoid nicking or inadvertent cutting of the control hoses 14 during assembly of the safety joint. Retainer sleeve 38 extending from flexible pipe termination 12 would be bolted to termination body 20 with weak link bolts 39. Alignment pin 42 would extend from retainer sleeve 38 into cam slots 36 of cam ring 34 and alignment slot 40 of retainer sleeve 38 would be oriented around alignment screw 41.

Upon tensioning of the control umbilical 10 a predetermined amount sufficient to cause the weak link bolts 39 to fail, retainer sleeve 38 separates from the termination body 20 and moves longitudinally relative thereto. The guide screw 41 in slot 40 provides for a longitudinal, non-rotational separation. As retainer sleeve 38 is separated from the termination body 20, alignment pin 42 moves in a direction parallel to the longitudinal axis of the safety joint. The movement of guide pin 42 in cam slot 36 causes a rotation of cam ring 34 about the longitudinal axis of the safety joint. The cutter blade 30 attached to the cam ring 34 rotates with respect to the alignment plate 26 and wear plate 28 attached to the termination body 20 severing the control hoses 14. Severing of the control hoses 14 cuts off the supply of hydraulic fluid to the valves and other parts of the subsea christmas tree to close the christmas tree valves in the christmas tree, to thereby close in the well to prevent loss of oil or gas from the well. The cutting of the control hoses 14 prevents damage to the control umbilical 10 due to stretching, and thus prevents damage to the christmas tree or the control hose connections 15 to the christmas tree.

Although the invention is described as anchoring a riser bundle to a subsea christmas tree in the operation of a subsea well, the invention is readily adaptable as a safety joint for other uses involving multi-tubes or control hoses without departing from the spirit and scope of the invention.

It should be understood that the foregoing description and drawings of the invention are not intended to be limiting, but are only exemplary of the inventive features which are defined in the claims.

What is claimed is:

1. A safety joint apparatus for cutting the flexible control hoses of a hose bundle which comprises:

a fixed plate having a hole for each control hose to pass therethrough;

a cutter plate movable relative to said fixed plate;

said cutter plate having a hole corresponding to each hole in said fixed plate for each control hose to also pass therethrough;

first tubular support means for said fixed plate;

second tubular support means for said cutter plate slidably concentric with said first tubular support; and actuating means operably interconnecting said first tubular support means and said second tubular support means to cause said cutter plate to move relative to said fixed plate upon separation of said first tubular support means and said second tubular support means relative to each other upon a predetermined tension being applied to the hose bundle for cutting the control hoses.

2. The apparatus of claim 1, wherein said actuating means includes:

a third tubular support means concentrically interposed between said first tubular support means and said second tubular support means; and guide pin means to cause said cutter plate to move rotationally relative to said fixed plate upon relative longitudinal movement between said first and second tubular support means.

3. The apparatus of claim 2, wherein said first tubular support and said second tubular support are connected by connection means which releases at a predetermined tension.

4. The apparatus of claim 3, wherein said connection means comprises weak link bolts.

5. The apparatus of claim 2, wherein said cutter plate comprises a rotating disc.

6. The apparatus of claim 5, wherein said cutter disc is rotated by said means to cause said cutter to move which comprises a pin in cam slot interconnection between said second tubular support and said third tubular support interposed between said first tubular support and said second tubular support whereby upon separation of said first tubular support from said second tubular support said pin guided by said slot imparts rotational movement to said third tubular support and said cutter blade attached thereto.

7. A safety joint apparatus adapted for cutting flexible control hoses when a predetermined tension is exceeded which comprises:

an outer housing connected to a section of flexible pipe;

an inner concentric housing connected to a section of a hose bundle;

connection means between said outer housing and said inner concentric housing which releases at a predetermined tension;

a pin and cam slot interconnection between said outer housing and a cam ring interposed between said outer housing and said inner concentric housing whereby upon separation of said outer housing from said inner concentric housing said pin guided by said slot imparts rotational movement to said cam ring;

a cutter blade attached to said cam ring having holes for the control hoses to pass therethrough;

at least one alignment means attached to said inner concentric housing having holes therethrough corresponding to the holes in said cutter blade;

whereby longitudinal movement between said outer housing and said inner concentric housing causes rotational movement between said blade and said alignment disc thereby severing the control hoses passing through said holes.

8. The apparatus of claim 7, wherein said section of flexible pipe is a flexible pipe termination means.

9. The apparatus of claim 7, wherein said connection means comprises weak link bolts connecting said outer housing and said inner concentric housing.

10. The apparatus of claim 7, wherein said cutter disc is oriented between an alignment plate and a wear plate and a severable locking pin provides alignment of holes through said cutter disc, said alignment plate and said wear plate prior to rotation of said cutter blade.

11. An umbilical safety joint which severs flexible control hoses upon tension failure which comprises:

an outer casing;

an inner concentric casing;

connection means between said inner casing and said outer casing which releases at a predetermined tension;

alignment means having a hole for each flexible control hose to pass therethrough mounted to said inner concentric casing;

a cutter blade having a hole corresponding to each hole in said alignment means for each control hose to pass therethrough;

rotating means interconnecting said cutter blade and said outer casing;

whereby upon longitudinal movement between said inner concentric casing and said outer casing said cutter blade rotates with respect to said alignment means thereby severing said control hoses.

12. The umbilical safety joint of claim 11, wherein said connection means comprises weak link bolts.

13. The umbilical safety joint of claim 11, wherein said alignment means comprises an alignment plate and a wear plate mounted to said inner concentric housing having holes therethrough to receive the control hoses.

14. The umbilical safety joint of claim 11, wherein said rotating means comprises a cam ring interposed between said outer casing and said inner concentric casing having a helical slot therein to receive a pin attached to said outer casing and having said cutter blade attached thereto whereby upon separation of said outer housing from said inner housing said pin moving in said slot imparts rotational movement to said cam ring and said cutter blade.

* * * * *